US010184205B2

(12) United States Patent
Bison et al.

(10) Patent No.: US 10,184,205 B2
(45) Date of Patent: Jan. 22, 2019

(54) LAUNDRY DRYER WITH DRAINABLE MOTOR SHAFT SEAT

(71) Applicant: Electrolux Appliances Aktiebolag, Stockholm (SE)

(72) Inventors: Alberto Bison, Pordenone (IT); Daniele Solerio, Casale Monferrato (IT); Piercarlo Novelli, San Quirino (IT)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 299 days.

(21) Appl. No.: 14/959,556

(22) Filed: Dec. 4, 2015

(65) Prior Publication Data

US 2016/0160425 A1 Jun. 9, 2016

(30) Foreign Application Priority Data

Dec. 5, 2014 (EP) ..... 14196642

(51) Int. Cl.

| | |
|---|---|
| ***D06F 58/00*** | (2006.01) |
| ***D06F 58/08*** | (2006.01) |
| ***D06F 58/20*** | (2006.01) |
| ***D06F 58/24*** | (2006.01) |

(52) U.S. Cl.

CPC ..... *D06F 58/08* (2013.01); *D06F 58/20* (2013.01); *D06F 58/24* (2013.01)

(58) Field of Classification Search

CPC ..... D06F 58/08; D06F 58/20; D06F 58/24; D06F 58/02

USPC ..... 34/108

See application file for complete search history.

(56) References Cited

U.S. PATENT DOCUMENTS

| | | | | |
|---|---|---|---|---|
| 5,768,730 | A * | 6/1998 | Matsumoto | D06F 25/00 210/144 |
| 2014/0137425 | A1* | 5/2014 | Kim | D06F 58/04 34/108 |
| 2014/0298671 | A1* | 10/2014 | Lee | D06F 58/04 34/108 |

FOREIGN PATENT DOCUMENTS

| | | | |
|---|---|---|---|
| DE | 102011089109 | A1 | 6/2013 |
| EP | 2458072 | A1 | 5/2012 |
| EP | 2674524 | A1 | 12/2013 |
| EP | 2752518 | A1 | 7/2014 |
| WO | 2014024354 | A1 | 2/2014 |

OTHER PUBLICATIONS

Extended European Search Report dated May 19, 2015 issued in corresponding European Application No. 4196642.4.

* cited by examiner

*Primary Examiner* — Kenneth Rinehart
*Assistant Examiner* — Bao D Nguyen
(74) *Attorney, Agent, or Firm* — RatnerPrestia

(57) ABSTRACT

A laundry dryer (2) includes a rotatable drum (6); a drying air fan for blowing air into the drum (6); and an electric motor (10) configured for rotating the drum (6) and/or the drying air fan. A shaft (30) of the electric motor (10) extends towards the drying air fan and/or a drum transmission system. A seat (80) which is at least partially concavely formed is positioned at least partially below the motor shaft (30). A draining device (82) is provided which is configured to allow liquid entering the seat (80) to be drained off.

16 Claims, 13 Drawing Sheets

LAUNDRY DRYER WITH DRAINABLE MOTOR SHAFT SEAT

CROSS REFERENCE TO RELATED APPLICATION

This application claims priority to European Application No. 14196642.4, filed Dec. 5, 2014, the content of which is hereby incorporated by reference in its entirety.

FIELD OF TECHNOLOGY

The present invention relates to a household appliance such as a laundry treating machine. In particular, the present invention relates to a household appliance suitable for drying clothes, i.e. a laundry dryer.

BACKGROUND

Laundry dryers are household appliances built for drying clothes and comprise a drying chamber or drum into which the clothes to be dried are introduced. The drying chamber is rotatably supported within a cabinet and made to rotate by means of a driving motor, typically consisting of an electric motor connected to the drying chamber via a belt. Operation of the dryer is controlled by the user through a control panel, typically situated on the front or upper panels of the cabinet.

Generally, laundry drying machines may be divided in two categories according to the air circuit type implemented therein with the purpose of managing air flow of drying air (process air). Laundry machines of a first category are denoted as vented dryers. In operation, vented dryers draw air from the outside into the laundry machine, heat it and then blow the heated air through the laundry to be dried and finally exhaust back outside such air together with moisture absorbed from the laundry. Laundry drying machines of the second category are denoted as condensation dryers. Condensation dryers are provided with a closed drying air circuit (process air circuit) comprising a moisture condensing unit—or simply condensing unit—adapted to condense moisture dispersed in process air. Therefore, there is no exhaustion of moisturized air from the laundry machine during operation.

Condensation dryers may be further subdivided in two subtypes according to the device used for condensing moisture from process air. The condensation dryers of the first subtype are provided with an air-air heat exchanger, which cools and de-moisturizes the process air by taking and then exhausting air from/to outside the dryer, thereby using ambient air as coolant. Conversely, the condensation dryers of the second subtype are provided with a heat pump system which has a refrigerant fluid evaporator portion for cooling and de-moisturizing the process air.

In a condensation dryer, a drying air inlet path is connected to the drying chamber on one side thereof, and a drying air exhaust path, e.g. another duct, starts from the other side of the drying chamber, while a drying air fan draws air through the inlet path and forces it through the drying chamber, from which the air exits via the exhaust duct.

An electric motor is provided to turn the drum or laundry drying chamber, and generally also the drying air fan, and, in a condense-type laundry dryer, also the cooling air fan. It is also possible that separate electric motors are used. Fan(s) and drum need to rotate to very different rotational speeds. For this reason, in case of one electric motor, the fan or the fans are usually mounted on the motor main shaft while the drum is driven by a first belt wound around the outer surface of the cylindrical drum and on an auxiliary shaft mounted on the motor casing. Such auxiliary shaft is typically rotated by the main shaft through a transmission arrangement comprising a second belt wound around a pulley, which is mounted on the auxiliary shaft, and a cylindrically grooved portion of the main shaft.

The European patent application EP 2 752 518 A1 discloses a laundry dryer with a laundry drying chamber rotatably mounted in a cabinet.

In order to mount the transmission arrangement on the motor and to allow maintenance interventions, the machine basement requires to include an appropriate seat which is formed between the motor casing attachment and the area in which the main motor shaft enters the drying air fan casing. Such seat has typically a concavity oriented upwardly, so it is prone to collect a liquid thereon.

Water collected in the transmission arrangement seat may be sprayed into the surrounding due to the rotational movement of the motor shaft, causing possible contact of water with live parts. According to the International Standard IEC 60335-1: "Household and similar electrical appliances-Safety", the term "live part" indicates a conductor or conductive part intended to be energized in normal use, including a neutral conductor but, by convention, not a PEN conductor, where a PEN conductor is a protective earthed neutral conductor combining the functions of both a protective conductor and a neutral conductor.

Contact of water with live parts can lead to malfunctioning of the dryer and damage of the dryer.

SUMMARY OF SELECTED INVENTIVE ASPECTS

It is an object of the presently disclosed inventive laundry dryer configurations to overcome at least some of the problems associated with the prior art.

A further object of aspects of the present invention is to provide a laundry drying appliance with can prevent malfunctions and damaging situations of liquid being sprayed on live parts of the laundry dryer.

Another object of aspects of the present invention is to provide a reliable laundry dryer in case of malfunctions related to presence of liquid in unwanted locations within the dryer.

According to an aspect of the invention, a laundry dryer comprises a rotatable drum, a drying air fan for blowing air into this drum, an electric motor configured for rotating the drum and/or the drying air fan, wherein a shaft of the electric motor reaches or extends towards the drying air fan and/or a drum transmission system, and wherein a seat which is at least partially concavely formed is positioned at least partially below the motor shaft, and wherein a draining device is provided which is configured to allow liquid entering the seat to be drained off.

Aspects of the invention are based on the consideration that laundry treatment appliances have the special condition that water and live components electronic are both present in spatially closely arranged regions and need to be separated, since contact of water with live components can lead to damaging conditions. If in an abnormal condition, which is possibly caused by malfunctioning and/or damaged components, liquid enters a spatial region around the drying air fan, water can be transported along the motor shaft. If it collects there, the rotation of the motor shaft can distribute and spray it against live components.

Applicant has found that by providing a draining device in a seat below the motor shaft, water which is entering this spatial region can be drained off and thereby leaves this region before it is distributed by the rotating motor shaft. The invention thus provides a draining device draining condensate liquid that might be collected in such seat. When the liquid has drained off, it can be directed to lower regions of the laundry dryer where it is less likely to lead to harmful conditions.

The terms "at least partially concavely formed" or "concavely shaped" indicate a region of material which has a concave shape. In the present application, this refers especially to parts with a concavity in a vertical direction, within which liquid entering such a region with gravity acting will collect or stay (absent a drain). Hence, in this seat, at least partially a basin-like structure is formed.

In the present application saying that a first component is "fluidly connected" to a second component means that fluid can in principle flow or otherwise move, for example by dripping, from the first component to the second component and vice versa. External conditions such as gravity can lead to only one or favor one flow direction.

The mounted position of the laundry dryer corresponds to the position and orientation in which it is positioned during regular operations, especially drying laundry which is positioned in the drum.

In one embodiment the seat is arranged adjacent to a drying air fan housing which encompasses the drying air fan and/or adjacent to the drum transmission system.

In one aspect, the draining device is arranged in the seat adjacent to the drying air fan housing and/or the drum transmission system. In such a configuration, the motor shaft is arranged above the seat and enters the drying air fan housing trough an opening. Water that enters the drying air fan casing can be sucked through this opening by the rotational motion of the motor shaft and then enter the seat. The seat can alternatively or additionally be located or arranged adjacent to the drum transmission system which is used to adapt the rotational speed of the motor shaft to an adequate rotational speed of the drum. The drum transmission system typically comprises a belt pulley assembly, the pulley being arranged on a second shaft arranged in parallel to the main motor shaft.

In a further aspect, the draining device is arranged at least partly at the bottom of the seat. Due to gravity, liquid entering the seat will be pulled to the bottom of the seat. If the draining device is located on the bottom of the seat, liquid can immediately be drained off and will not collect in the seat.

In a preferred embodiment the draining device comprises a hole. This solution basically provides an exit for liquid by providing an opening in the seat through which liquid will fall or drip due to gravitational forces.

Preferably below the hole a collecting basin is positioned for collecting liquid flowing through the hole. The collecting basin collects liquid that drips through the hole and prevents this liquid to flow into other parts of the dryer or to leave the dryer.

The motor is advantageously received in a receptacle placed adjacent to the seat. The receptacle provides a dedicated space for the insertion of the motor.

Preferably between the seat and the receptacle a motor holding member 135 (see FIG. 6) is arranged. The motor holding member is preferably formed by a wall on which one motor end part rests. In this design, preferably a reversed U-shaped member is connected at the top of the wall to encircle this motor end part.

In a preferred embodiment the laundry dryer comprises a basement placed under the drum, the seat being formed in a portion of the basement. The basement in the mounted position of the laundry dryer is the part which rests on the floor on which laundry dryer is standing. The basement is preferably built of two shells, an upper shell and a lower shell, which can be engaged or joined with one another. The basement is preferably made of polymeric material and is advantageously formed by an injection moulding process.

The receptacle is preferably formed in a portion of the basement. Most preferably, it is formed in a portion of the lower shell of the basement.

In a preferred embodiment the draining device comprises a tilted surface which fluidly connects a first region of the seat able to collect liquid to a second region at a lower elevation relative to the seat, in a mounted position of the laundry dryer. In this design, liquid can run down the tilted surface and leave the seat. Also in this design, a draining hole can be provided, preferably at the second region. Liquid running down the tilted surface can then enter this hole and drip further down. Additionally, a collecting basin can be provided below this hole for collecting the liquid dripping or flowing through the hole. Another embodiment comprises the tilted surface as described and no hole but a collecting basin can be provided in the second region for liquid running down the tilted surface can collect. The draining device can thus comprise a tilted surface in combination with a hole, wherein at the second region a hole is provided through which the liquid running down the tilted surface can be drained off to an even lower third region. Preferably, under the hole a basin can be proved for collecting the liquid.

In one aspect, the draining device comprises a drain channel. The drain channel is preferably built as a pipe. The drain channel is preferably removably attachable to the seat and/or border of the draining hole or the tilted surface. The titled surface is in this case preferably at least partially concavely shaped to form a channel which can guide liquid into the drain channel.

The drain channel is advantageously fluidly connected to a collecting basin which, in a mounted position of said dryer, is located at a lower elevation compared to the bottom of the seat.

In a preferred embodiment the laundry dryer comprises a drying air moisture removing device comprising an air-air type heat exchanger or a section of a heat-pump system.

Preferably the drum transmission system comprises a belt-pulley-arrangement. The rotation of the shaft of the motor is transmitted by a belt to a pulley which is arranged on a second shaft arranged parallel to the main shaft, wherein a primary belt is rotating with the second shaft and is connected to the drum. This way, the rotation speed of the main motor shaft can be adapted to an adequate rotation speed of the drum.

According to aspects of the invention, by providing a draining device in the seat below the motor shaft, the risk of damages to the dryer caused by liquid getting in touch with live components can be dramatically reduced, leading to an increased life-time of the dryer and an operation mode with improved safety. By employing a draining channel, liquid draining off can be precisely guided to another place or region where it cannot lead to further risks. By employing a dedicated basin for collecting this liquid, it can be kept in a limited region and be further confined.

BRIEF DESCRIPTION OF THE DRAWINGS

Further features and advantages of the present invention shall become clearer from the following detailed description of some of its preferred embodiments, made with reference to the attached schematic drawings and given as an indication and not for limiting purposes.

In particular, the attached drawings are included to provide a further understanding of the invention and are incorporated in and constitute a part of this specification. The drawings together with the description explain the principles of the invention. In the drawings, corresponding characteristics and/or components are identified by the same reference numbers. In these drawings.

DETAILED DESCRIPTION OF EXAMPLE EMBODIMENTS

While the invention is described in connection with preferred embodiments, it is not intended to limit the scope of the invention to the particular form set forth, but on the contrary, it is intended to cover such alternatives, modifications, and equivalents as may be included within the scope of the invention as defined by the appended claims. Even if the invention will be described here below with reference to a condenser-type laundry dryer, the invention may be applied also in a vented-type laundry dryer.

Figure 1:
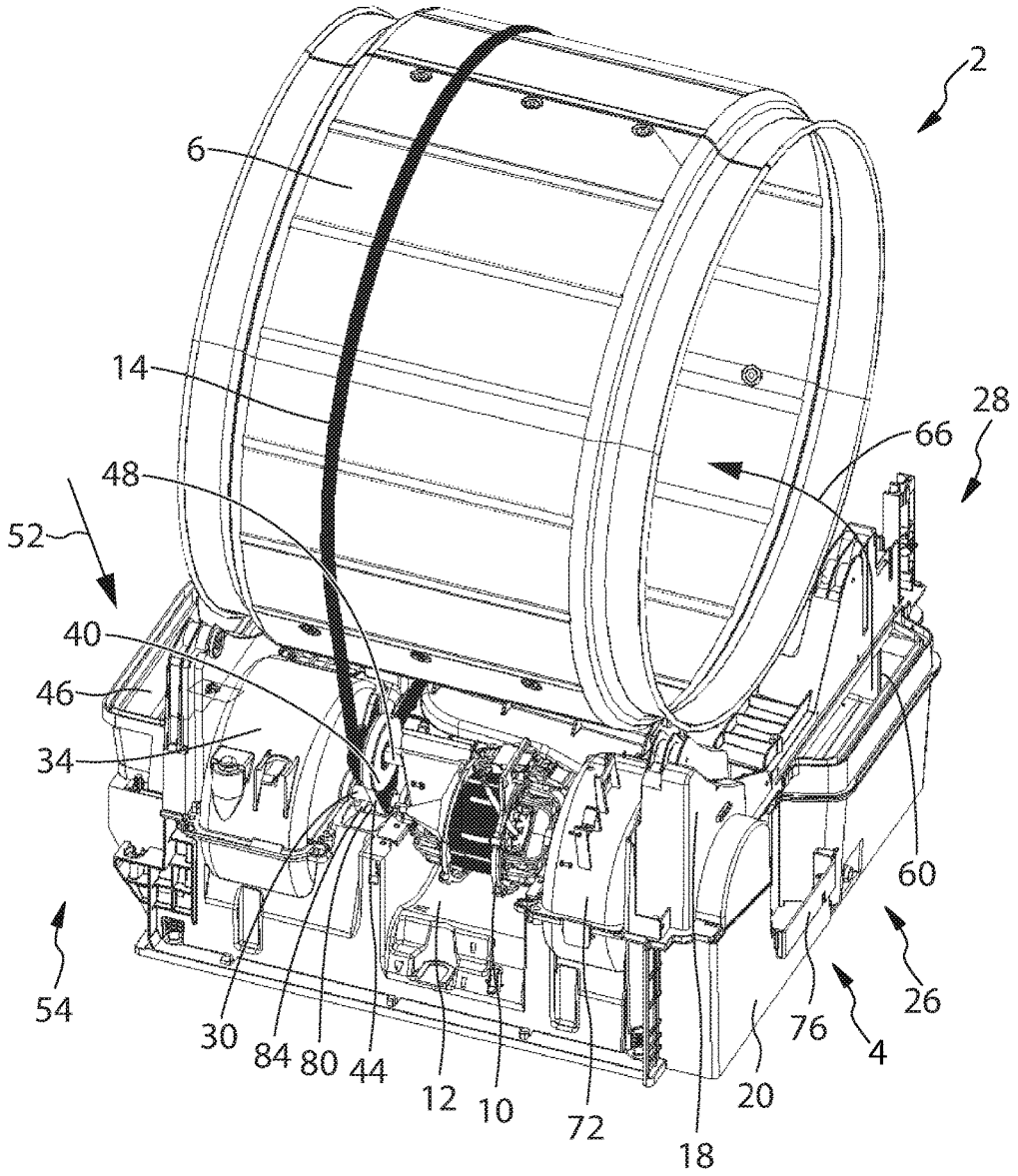
FIG. 1 shows a schematic perspective view of a laundry dryer with parts of its casing removed with a rotatable drum, an electric motor, a drying air fan casing, a seat and a draining device in a preferred embodiment.
Figure 2:
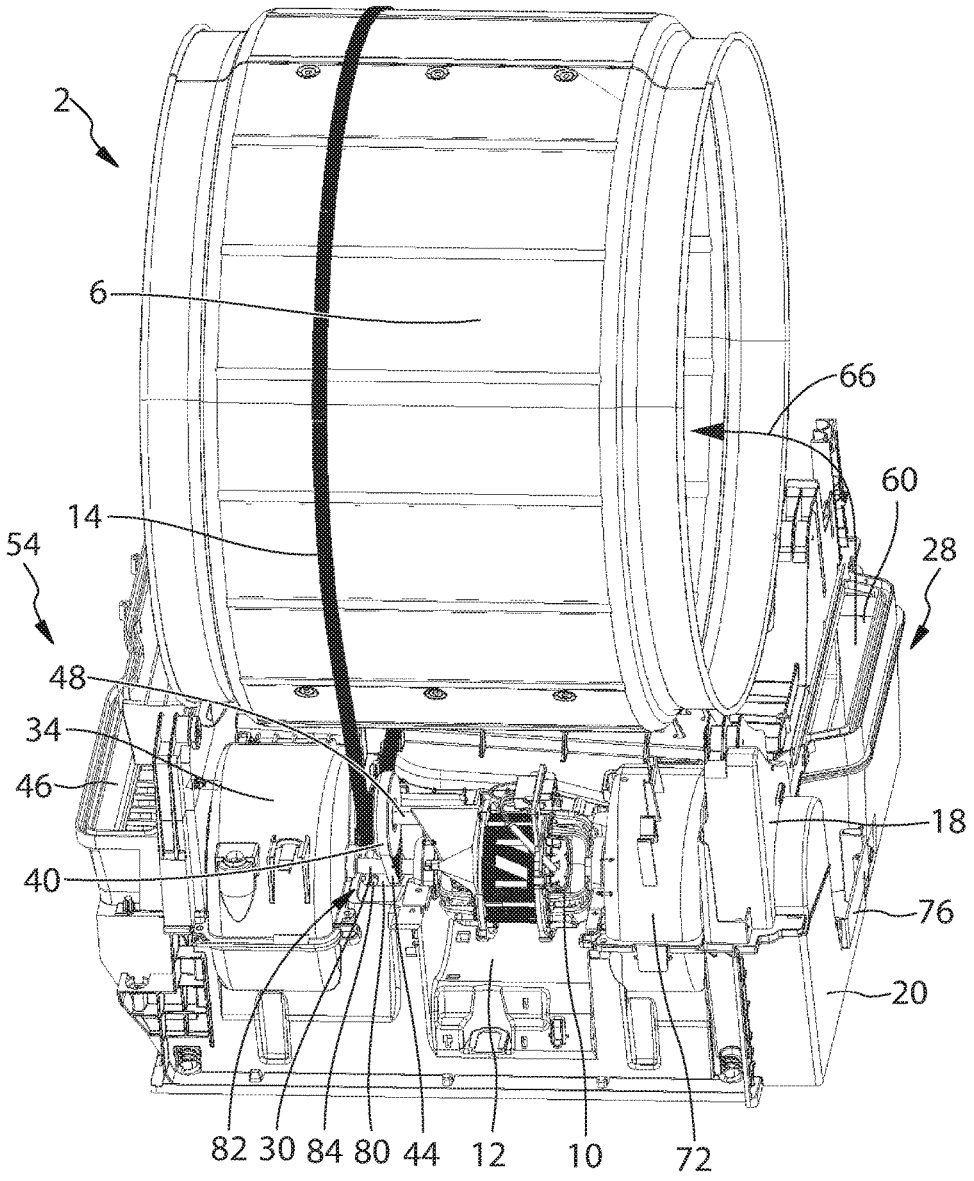
FIG. 2 shows another schematic perspective view of the laundry dryer of FIG. 1.

A laundry dryer 2 shown in FIGS. 1 and 2 in a preferred embodiment comprises a drum 6 which functions as a laundry drying chamber into which the clothes to be dried are introduced. Drum 6 can be closed by a door (not shown) and is rotatably supported within a casing or housing (only partly shown) which is preferably built as a cabinet 8. Drum 6 is made to rotate by means of a driving means, which in the present case comprises an electric motor 10 which is connected to drum 6 via a drum driving belt 14 and is housed in a motor housing or receptacle 12. Laundry dryer 2 further comprises a basement 4 which functions to cover and protect the interior components from outside influences. Basement 4 comprises an upper shell 18 and a lower shell 20. The upper shell is interposed between drum 6 and the lower shell 20 which, in a mounted and operational position of laundry dryer 2, is adjacent to the floor on which laundry dryer 2 is placed. The basement 4 may be configured to rotatably support the drum 6 thereon. Further drum supports may be provided on the laundry dryer casing.

Electric motor 10 comprises a main motor shaft 30 which is rigidly connected to a drying air fan which is placed in a drying air fan housing 34. The main motor shaft 30 can also be built in a one-piece design with an axis of the drying air fan. Since the rotational speeds of the drying air fan and the drum 6 have to be quite different during operation, the drum is rotated by electric motor 10 and a drum transmission system comprising a pulley 40, a transmission belt 44 or secondary belt and a secondary shaft 48. The use of this drum transmission system allows rotating both drum 6 and drying air fan by the same and identical electric motor 10.

Laundry-dryer 2 is built as a condenser-type dryer with an air-air type heat exchanger. Drying air from drum 6 is sucked in through a corridor 46 by the drying air fan at a front side 54 of laundry dryer 2, along a path which is schematically indicated by an arrow 52. At rear side 28 of the laundry dryer 2, drying air is supplied to the drum 6 through a corridor 60, along a path schematically indicated by an arrow 66. Before drying air is blown into drum 6, moisture is removed from the drying air by a drying air moisture removing device which is cooled through a cooling air fan placed in a cooling fan housing 72. A condensate collector 76 is provided to collect moisture removed from drying air, preferably at a bottom part 26 of the rear side 28 of the basement 4.

During operation of laundry dryer 2 in case of a malfunction, liquid, especially water, e.g. condensate, removed from drying air, can enter the drying air fan housing 34. A cause of such malfunction can be due to failure of a pumping device and/or a pumping device activator preferably provided in the condensate collector 76 to move condensate from the collector 76 to another reservoir which can be manually removed from the dryer by a user to be periodically emptied. Due to rotation of main motor shaft 30 liquid can be sucked from drying air fan housing 34 to a seat 80 which is placed below main shaft 30 and which is at least partially concavely formed, which means that at least part of it has a surface with a concave shape which allows liquid to collect. If water continues to collect, it can be distributed and sprayed by rotating motor shaft 30 into the surrounding and get in contact with live parts, which can lead to further malfunction and severe damage of the laundry dryer 2.

Laundry dryer 2 is designed to avoid such scenario of liquid collecting in seat 80. It therefore provides a draining device 82 that allows liquid collecting in this region to be drained off. In the present embodiment, the draining device 82 is designed as a draining hole 84. Liquid that enters draining hole 84 is due to gravitational pull moving towards the bottom of laundry dryer 2 where it is farther away from live components.

Figure 3:
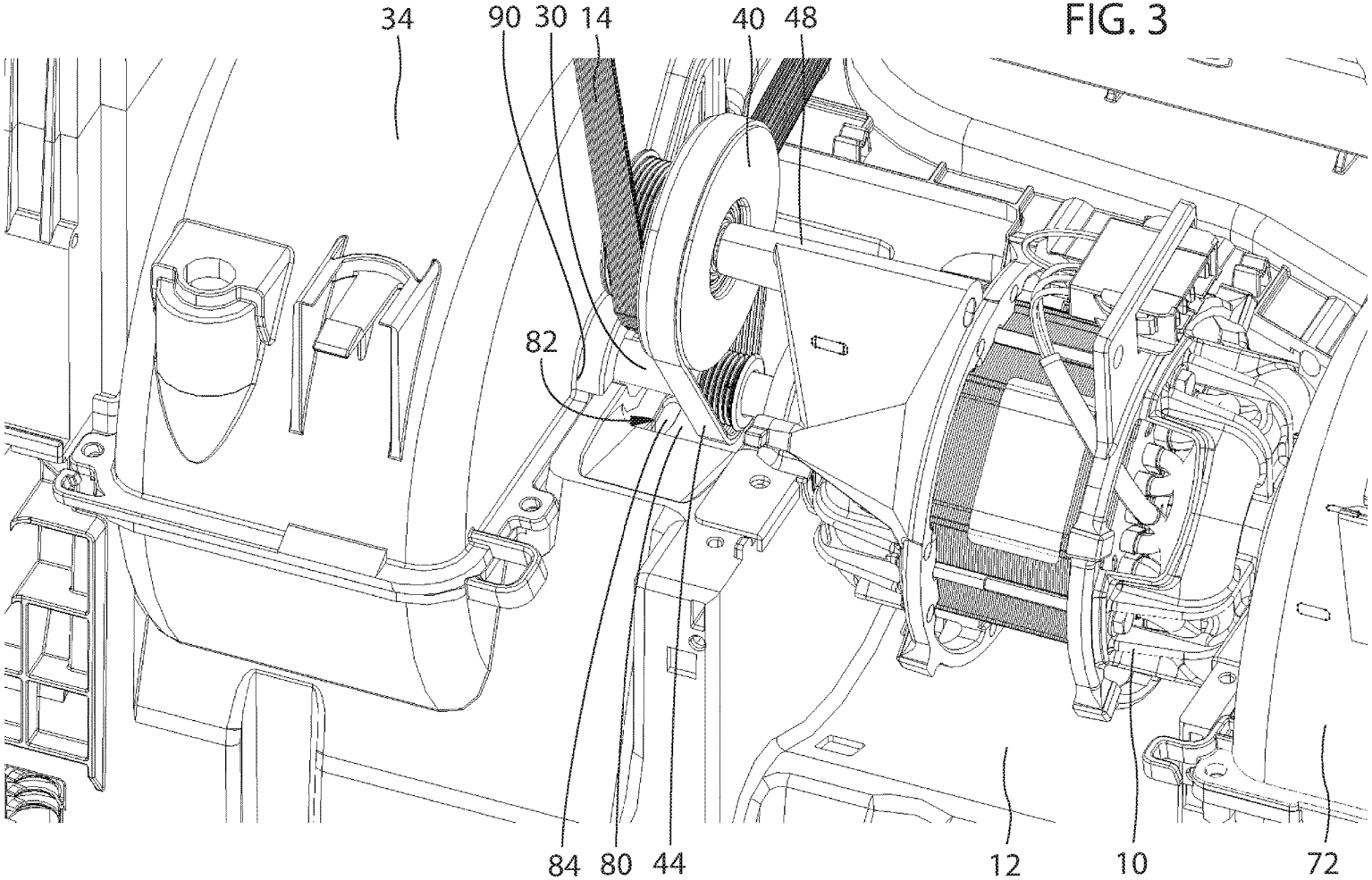
FIG. 3 shows an enlarged view of the laundry dryer of FIG. 1.

In FIG. 3, an enlarged view of laundry dryer 2 is shown. Between drying air fan housing 34 and main motor shaft 30, an annular gap 90 or annular passage is formed, through which liquid, especially water, e.g. condensate, can leave drying air fan housing 34 and drip into seat 80 and would collect there if it was not allowed to drain off through draining hole 84.

Figure 4:
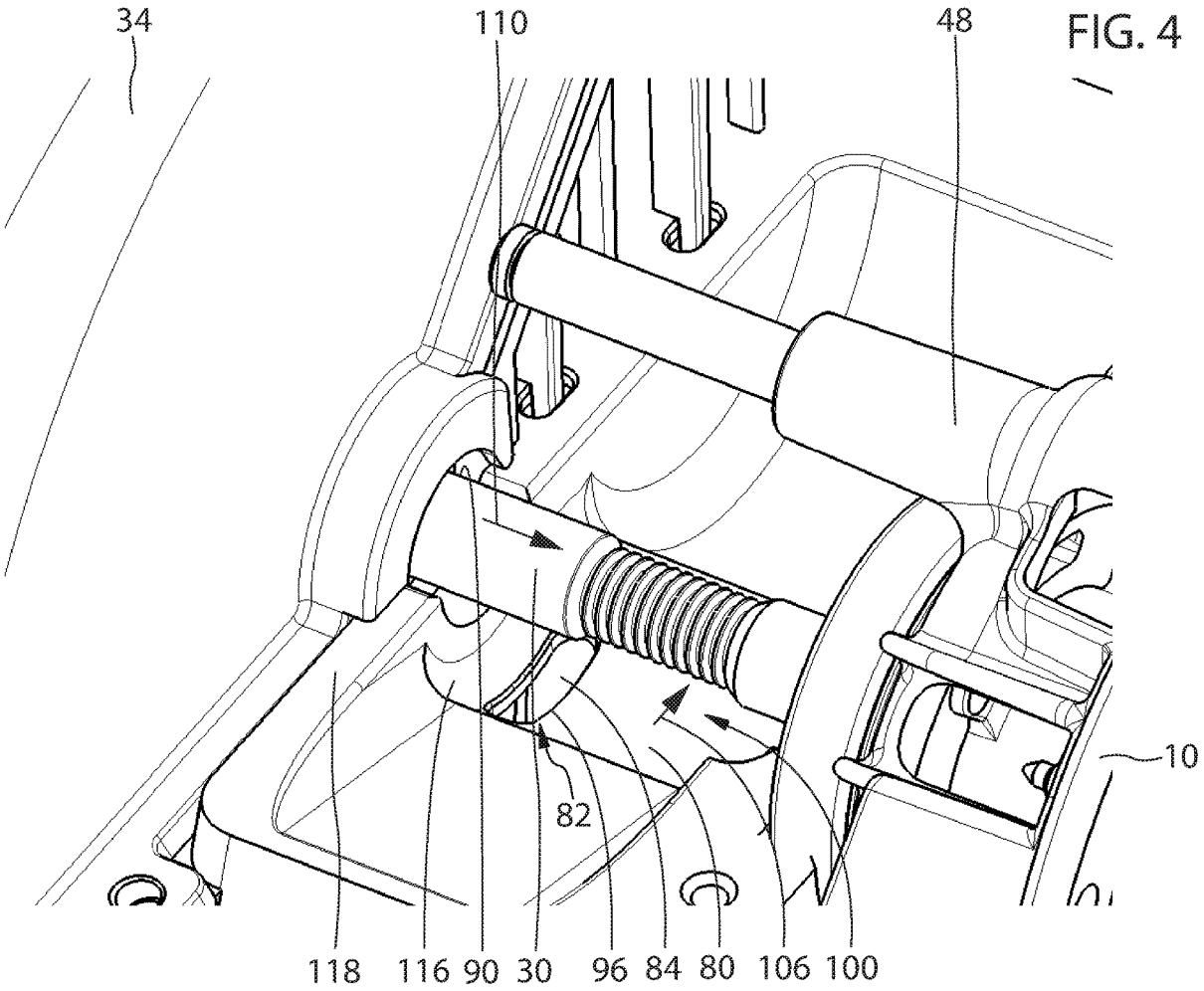
FIG. 4 shows another enlarged view of the laundry dryer of FIG. 1 with some components removed for better visibility.

Draining hole 84 can be seen in more detail in FIG. 4. It is positioned adjacent to drying air fan housing 34 at the bottom of seat 80. Due to its adjacent position, liquid that drips through annular gap 90 and falls down due to gravity can immediately drain off through draining hole 84. The border 96 of draining hole 84 is concavely shaped in accordance with seat 80. Draining hole 84 has an extension along main motor axis 30 which is smaller, approximately half as long, as its extension perpendicular to main motor axis 30. Border 96 has essentially a shape of two semicircles which are joined by lines following the bottom of seat 80 and running in parallel perpendicularly to main motor axis 30. Its border 96 can also be described as a rectangular shape with rounded corners that form quadrants. Draining hole 84 can have other shapes as long as its function to allow liquid entering seat 80 to drain off, meaning that it will leave this area or region and preferably will move to a region of lower elevation due to a pull of gravitational force. Since draining hole 84 is designed to drain off liquid that would accumulate on the seat 80, it should be left free from objects that may cover, i.e. obstruct it even partially, and its shape should be the most adapted to let liquid to pass through it.

Seat 80 comprises a bottom part 100 which is at lower height than adjacent parts in a cross direction 106 (or in opposite direction) perpendicular to axial direction 110 of main shaft 30. Looking in opposite direction of axial direction 110, a curved surface 116 is positioned below the annular gap 90 and a border part 118 adjacent to drying air fan housing 34. A similar curved surface is also arranged opposite to surface 116 looking in axial direction 110. This way, bottom 100 of seat 80—without draining hole 84—would act like a basin due to being essentially concavely formed in cross direction 106 as well as in direction 110 perpendicular to cross direction 106.

Figure 5:
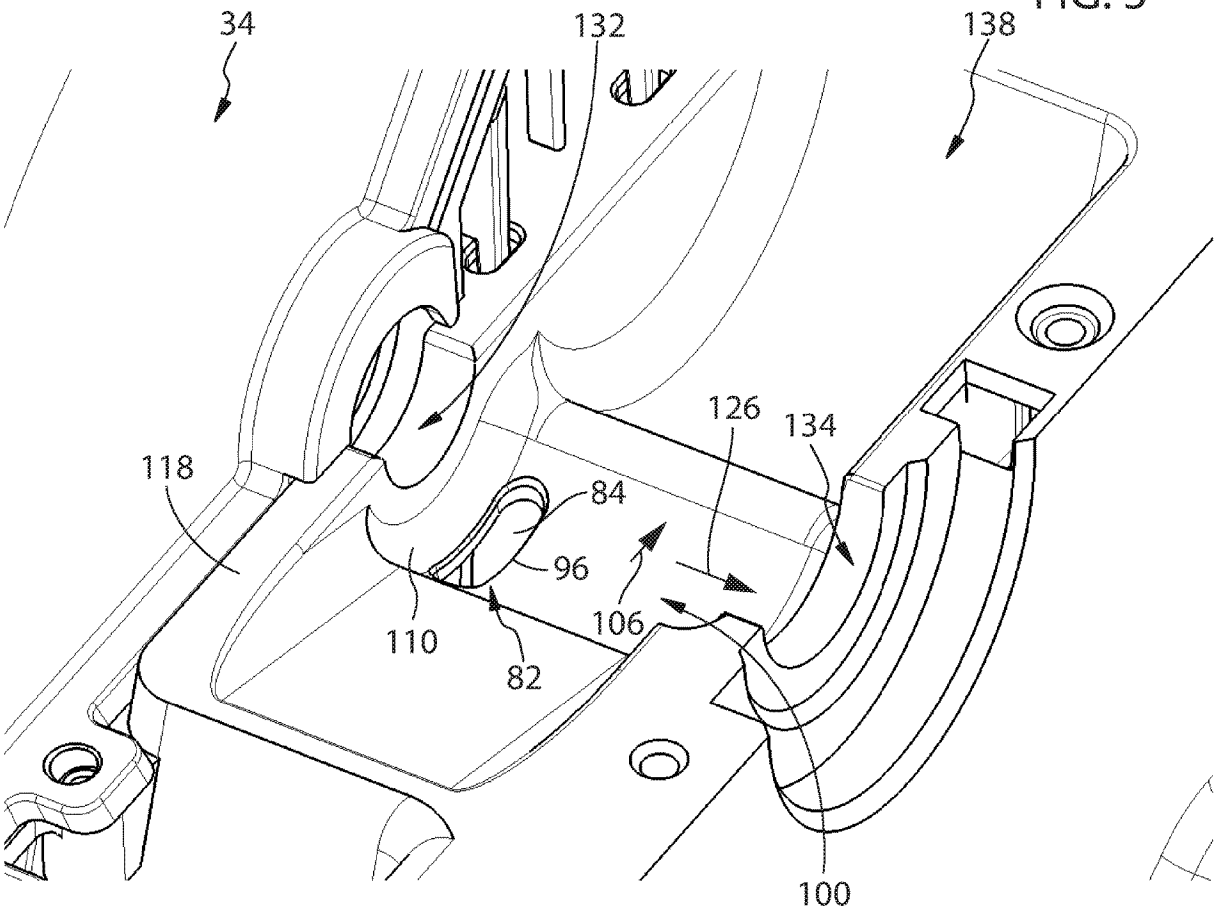
FIG. 5 shows still another enlarged view of the laundry dryer of FIG. 1 with the shafts removed for better visibility.

FIG. 5 shows essentially a perspective view as in FIG. 4 but with main motor shaft 30 and electric motor 10 removed. Substantially semi-circular openings 132, 134 for main motor shaft 30 are displayed as semi-cuts. Over the opening 134 a motor 10 fixing element can be mounted. Such element preferably has a substantially semi-circular opening that, together with the substantially semi-circular opening 134 forms a substantially circular opening accommodating and holding a motor 10 end. Arranged adjacent to seat 80 is a transmission arrangement seat 138 which is positioned below the components that allow a transmission of the rotation of motor shaft 30 to a rotational speed suitable to rotate drum 6, see FIGS. 1 to 3. In drying air fan casing 34, a fan seat 154 is installed.

Figure 6:
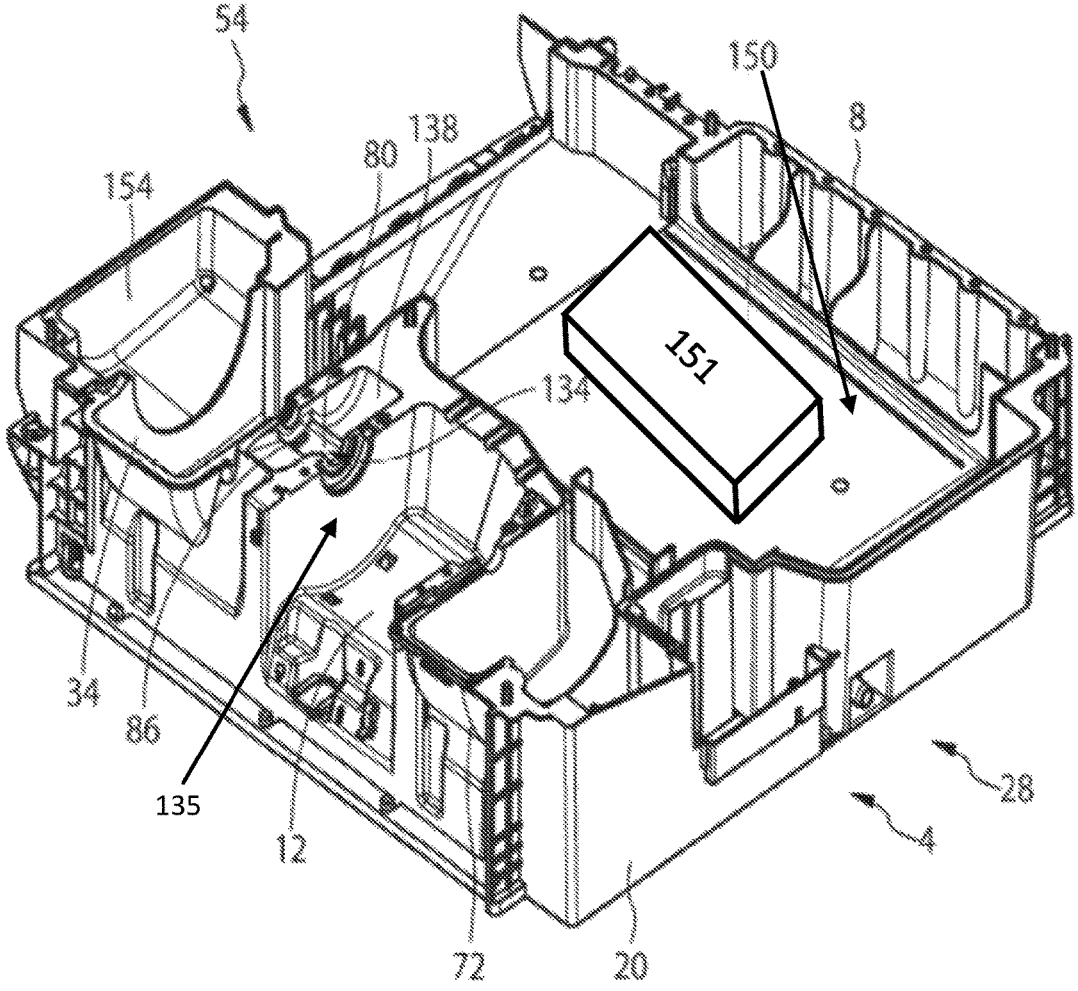
FIG. 6 shows a perspective view of the basement and its housings to receive components of the laundry dryer of FIG. 1.

In FIG. 6, a lower part of laundry dryer 2 is displayed with lower shell 20 and components arranged within lower shell 20. Lower shell 20 is one component of basement 4 which can be engaged with an upper shell 18, shown in FIGS. 1 and 2. In this view a housing 150 for accommodating a moisture removing device 151 (illustrated schematically), such as an air-air type heat exchanger can be seen which is positioned adjacent to cooling fan housing 72. In other embodiments of the present invention, the moisture removing device can be in the form of a section of a heat-pump system, i.e. a refrigerant evaporating unit.

Figure 7:
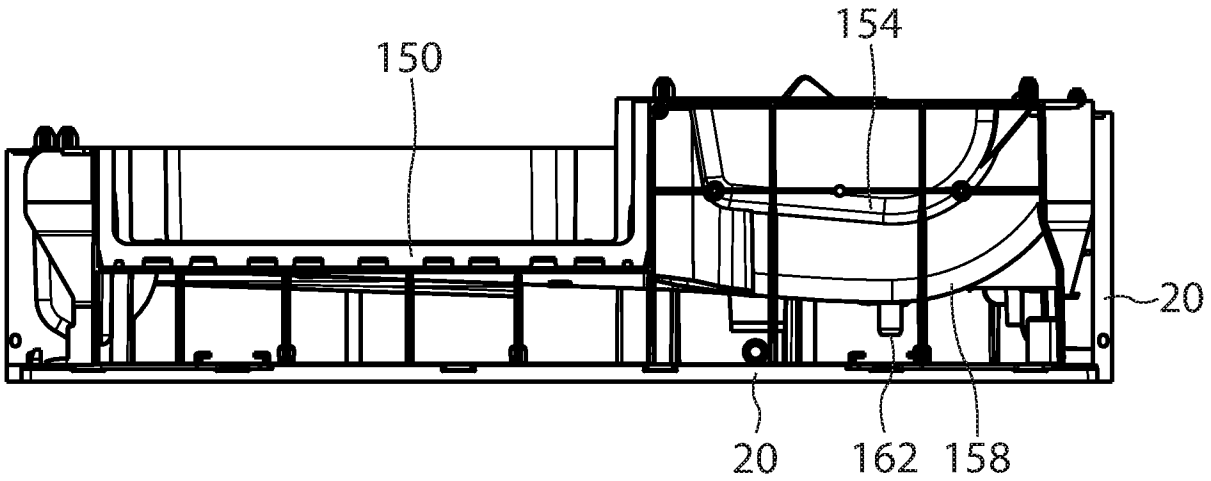
FIG. 7 shows a front view of the basement shown in FIG. 6.

As can be seen in FIG. 7, in a bottom portion 158 of the drying air fan seat 154 a condensate draining pipe 162 is provided to be fluidly connected with the collector 76. During regular, i.e. normal operation of the laundry dryer 2, condensate draining pipe 162 serves to drain moisture that condenses on the drying air fan seat 154. On the contrary, in case of a laundry dryer malfunction due to failure of a pumping device and/or a pumping device activator preferably provided in the condensate collector 76, such collector 76 is continuously supplied with condensate without possibility of being emptied and therefore pipe 162 transfers liquid from collector 76 to the drying air fan seat 154, becoming in this way a further source of liquid flooding the drying air fan seat 154.

Figure 8:
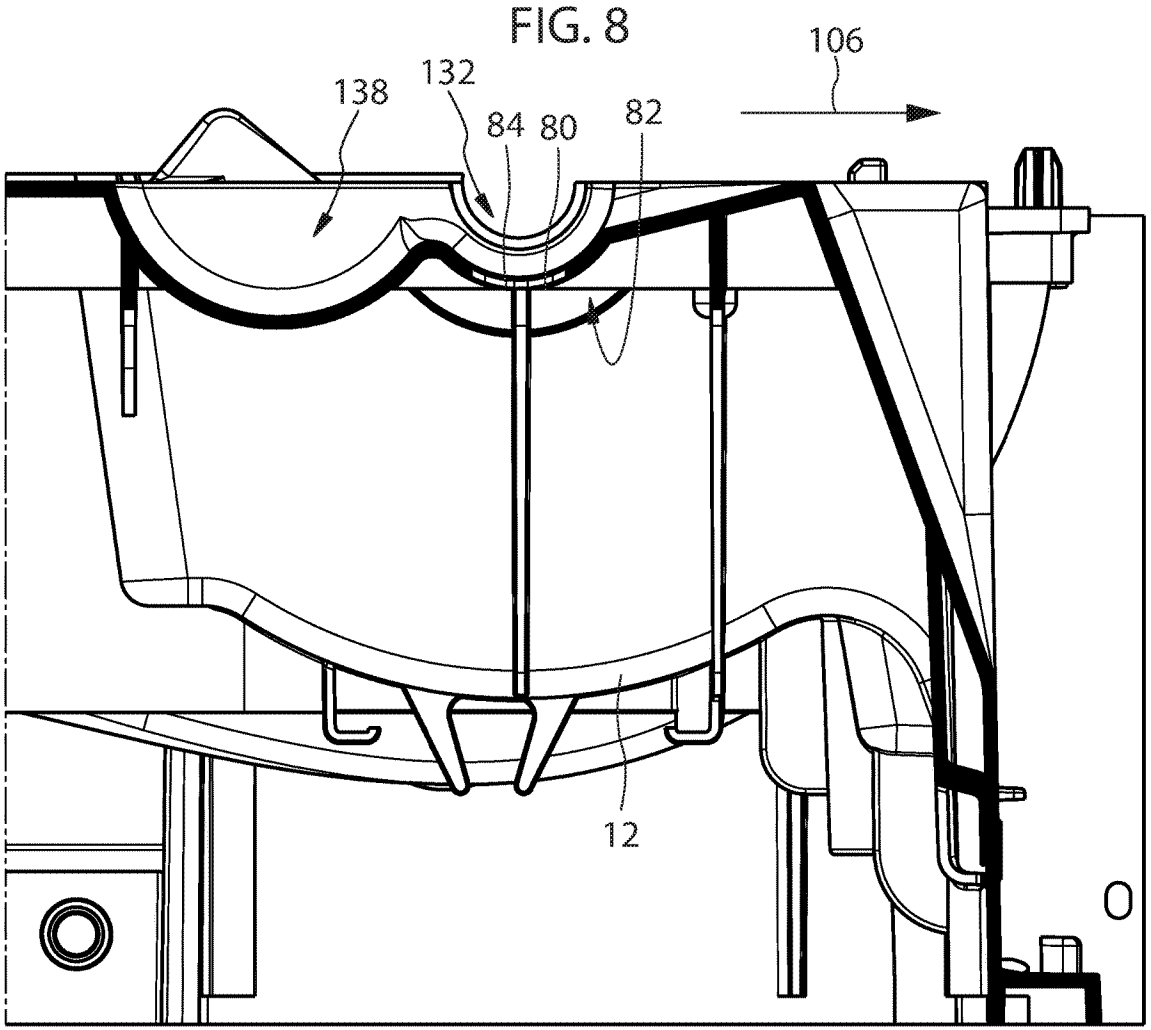
FIG. 8 shows a sectional view of the basement shown in FIG. 6.

A sectional view of laundry 2 is shown in FIG. 8 which corresponds to a view direction from the front part 54 to the rear part 28 and also in axial direction 110 or direction 126. In this view, the concave cross sections of seat 80 and draining hole 84 are clearly visible. The cross section of seat 80 is partly formed as a segment of a circle, and correspondingly the cross section of draining hole 84 is formed as a segment of a circle.

Figure 9:
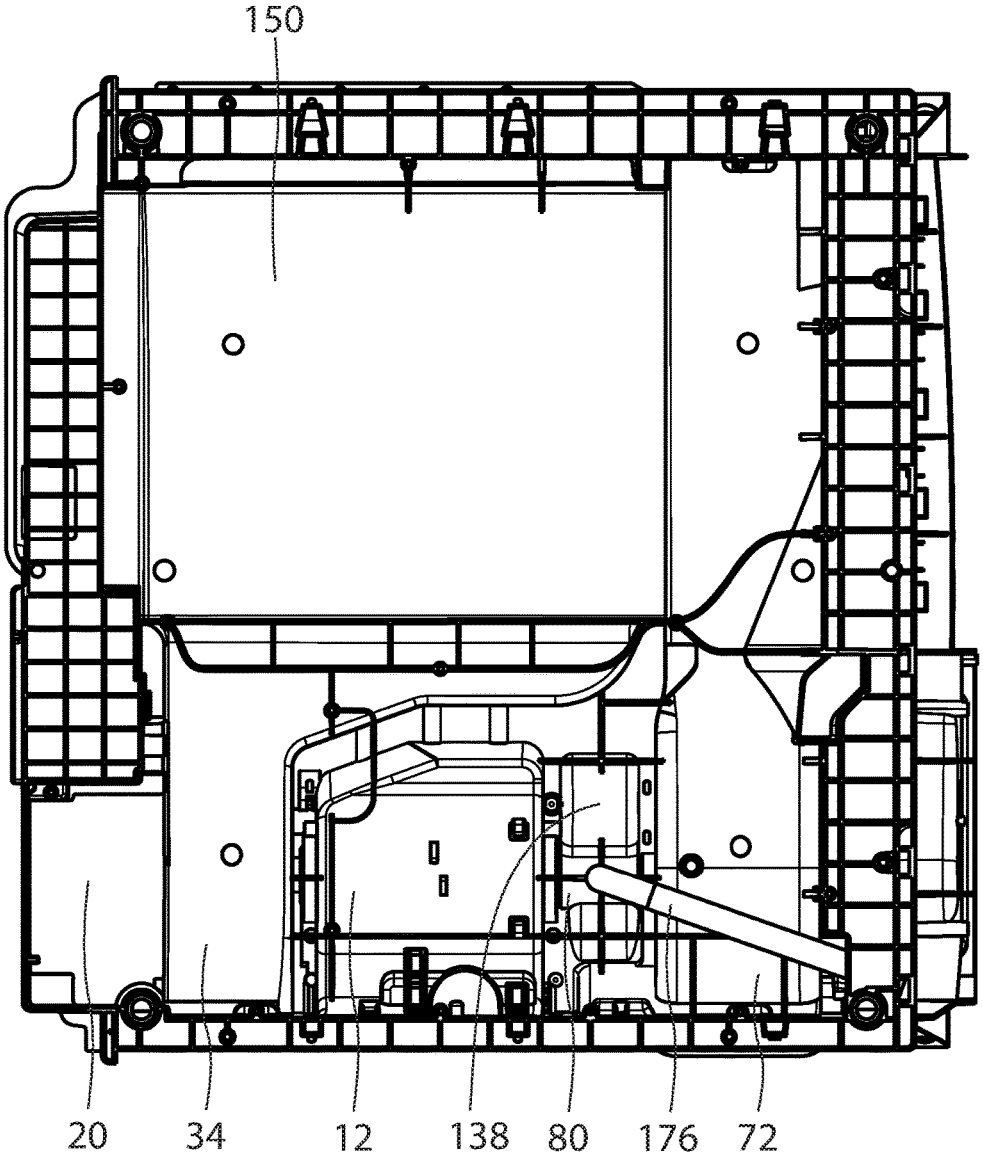
FIG. 9 shows a bottom view of a laundry dryer in a second preferred embodiment.
Figure 10:
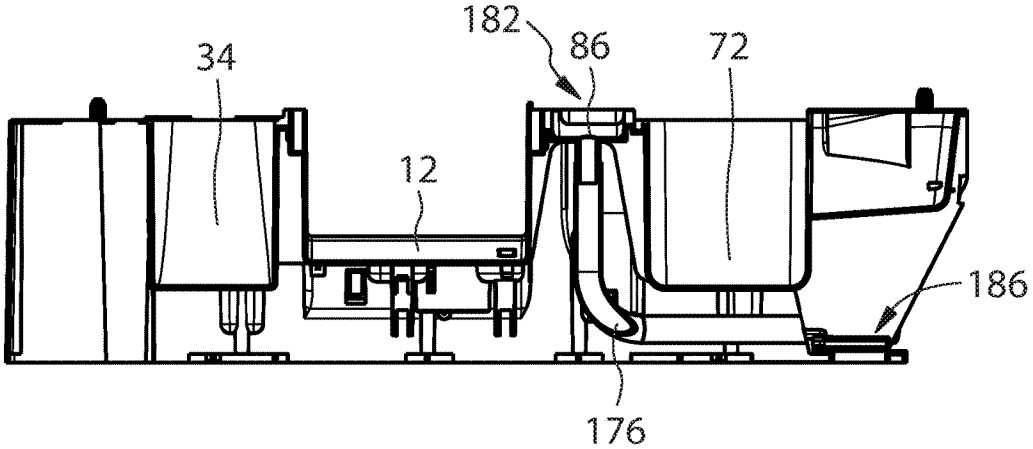
FIG. 10 shows a sectional view of the laundry dryer of FIG. 9.
Figure 11:
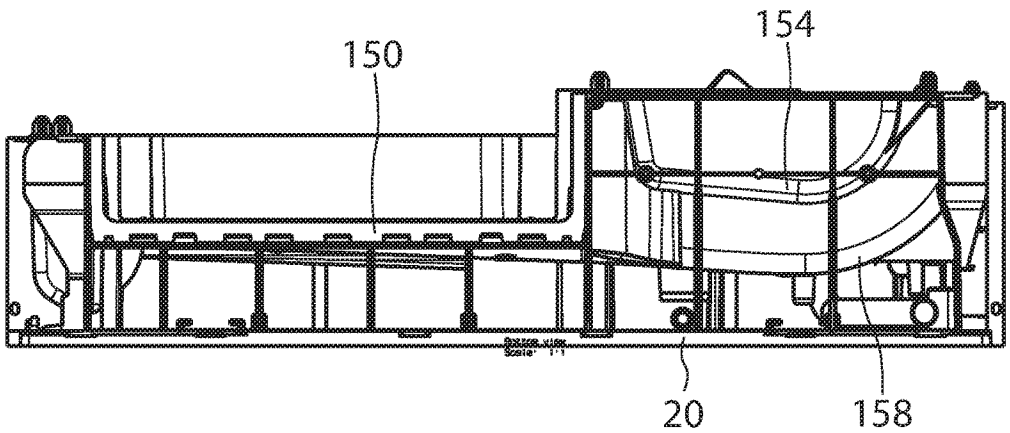
FIG. 11 shows a front view of the laundry dryer of FIG. 9.

In FIGS. 9, 10, and 11 a laundry dryer 2 in a second preferred embodiment is shown in a bottom view, sectional view, and front view, respectively. It differs from laundry 2 according to the previous Figures in the design of the draining device. Other components are preferably built in the same way as discussed above. The laundry dryer 2 according to such second preferred embodiment has a draining device which comprises a draining hole 86 at the bottom of seat 80 which is fluidly connected to a drain channel 176 through which liquid entering draining hole 86 can flow and leave seat 80. As can be seen in the Figures, drain channel 176 is built as a pipe which is preferably made of plastic material, which is most preferably elastic material. Drain channel 176 is preferably connected removably to seat 80 and/or border of draining hole 86 which allows its replacement and/or cleaning. Through drain channel 176, in the mounted position of laundry dryer 2 which corresponds to the position and orientation in which it is used during regular operations for drying laundry, liquid entering draining hole 84 at an upper first region 182 is guided to a second region 186 lower in elevation compared to the first region 182. At the end of drain channel 176 in second region 186, a basin can be provided for collecting liquid.

Figure 12:
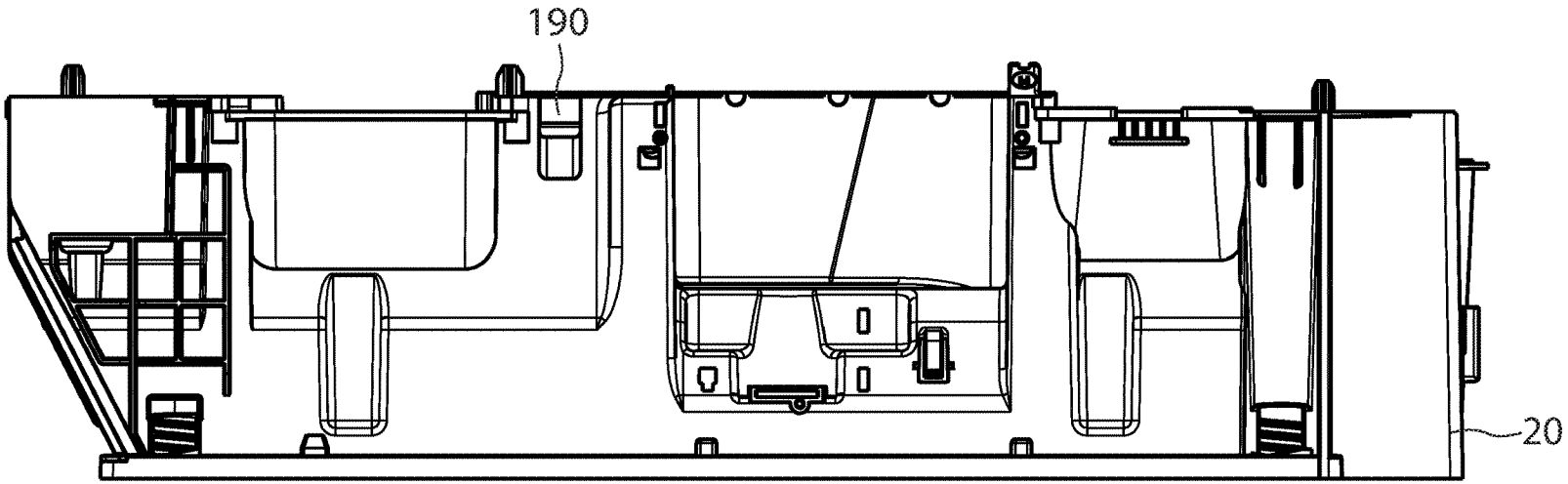
FIG. 12 shows a lateral view of a laundry dryer in a third preferred embodiment.
Figure 13:
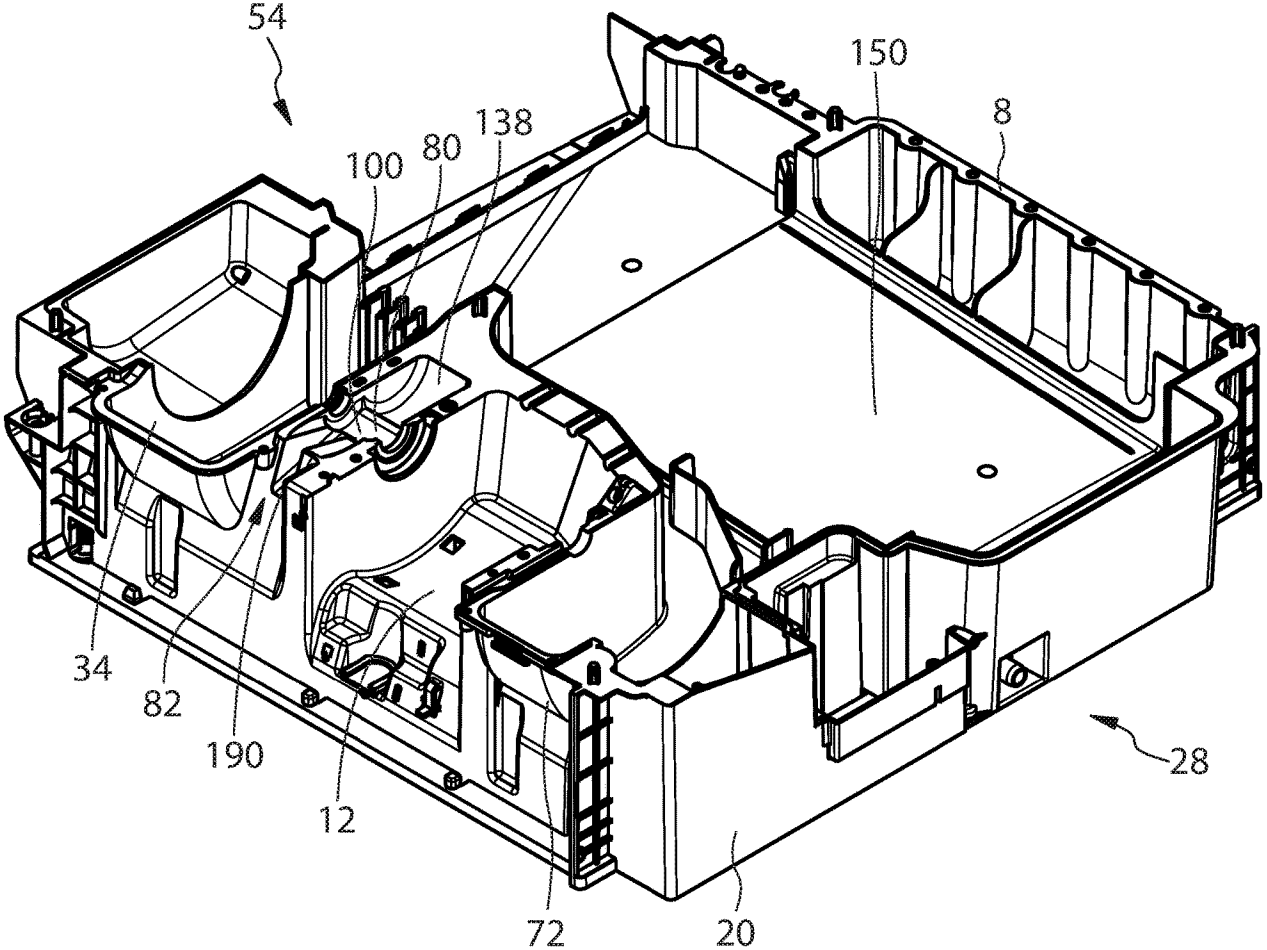
FIG. 13 shows a perspective view of the laundry dryer of FIG. 12.

In FIGS. 12 and 13, a laundry dryer 2 in still another preferred embodiment is shown in a lateral view and perspective view, respectively. The laundry dryer 2 shown in FIGS. 12 and 13 corresponds to the laundry dryers of FIGS. 1 to 8 but differs in the design of the draining device 82. In the embodiment shown, the draining device is built as a tilted surface 190 of seat 80. When liquid is collecting in bottom region 100 of seat 80 and starts to fill this region, it will start to run down the tilted surface 190 and leave seat 80.

Figure 14:
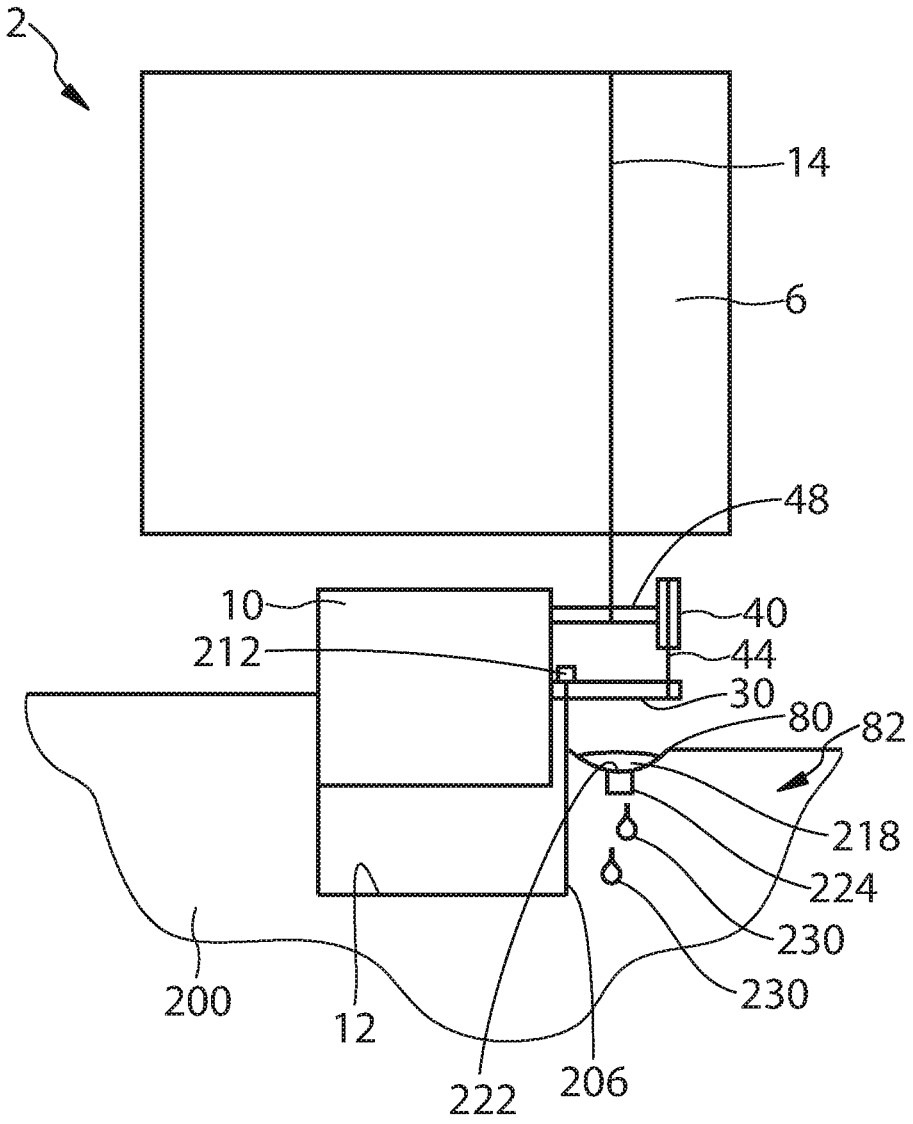
FIG. 14 shows a schematic view of a laundry dryer in a fourth preferred embodiment.

In FIG. 14, a laundry dryer 2 in yet another preferred embodiment is shown. A basement 200 of laundry dryer 2 is schematically shown. Electric motor 10 is positioned in a seat 12. A bracket 206 is provided for fixing motor 10 to basement 200. Motor 10 is fixed to bracket 206 by a fixing element 212 which has a reversed U-shape. Motor 10 rotates main motor shaft 30, which through a second belt 44 engages with pulley 40 on secondary shaft 48 which drives belt 14. In the configuration shown, motor 10 is only driving drum 6 and not the drying air fan. The drying air fan is rotated by a second separate motor (not shown). Also in the configuration shown, below main motor shaft 30, a seat 80 which is partially concavely formed is placed in which liquid 218 can potentially collect. A draining device 82 comprising a draining hole 222 at the bottom of seat 80 and a guiding tube 224 allows liquid to drain through draining hole 222 and fall to a lower part in basement 200, as indicated by drops 230. A basin can be provided below draining hole 222 for collecting liquid that ran through draining hole 222. Naturally, each of the embodiments of the draining device 82 can be applied to the embodiment of the laundry dryer 2 disclosed in FIG. 14.

A second draining device, embodied in any of the forms disclosed above, can be provided below the motor shaft of the secondary motor which drives the drying air fan in case that the shaft is arranged above a seat which is at least partly concavely formed and is prone to collect liquid.

It will be appreciated that alternations and modifications may be made to the above without departing from the scope of the disclosure. Naturally, in order to satisfy local and specific requirements, a person skilled in the art may apply to the solution described above many modifications and alterations. Particularly, although the present disclosure has been described with a certain degree of particularity with reference to preferred embodiments thereof, it should be understood that various omissions, substitutions, and changes in the form and details as well as other embodiments are possible. Moreover, it is expressly intended that specific elements described in connection with any disclosed embodiment of the disclosure may be incorporated in any other embodiment as a general matter of design choice.

The invention claimed is:

1. A laundry dryer, comprising:

a rotatable drum;

a drying air fan for blowing air into said drum; and an electric motor configured for rotating said drum and/or said drying air fan;

wherein a shaft of said electric motor extends towards said drying air fan and/or a drum transmission system, a seat which is at least partially concavely formed is positioned at least partially and immediately below said motor shaft and extends from the drying air fan to the electric motor, the seat including at least one cut out portion through which the shaft extends, and a draining device is provided in the seat immediately below said motor shaft to allow liquid entering said seat to be drained off.

2. The laundry dryer according to claim 1, wherein said seat is arranged adjacent to a drying air fan housing which encompasses said drying air fan, and/or adjacent to said drum transmission system.

3. The laundry dryer according to claim 2, wherein said draining device is arranged in said seat adjacent to said drying air fan housing and/or said drum transmission system.

4. The laundry dryer according to any claim 1, wherein said draining device is arranged at least partly at the bottom of said seat.

5. The laundry dryer according to any claim 1, wherein said draining device comprises a hole.

6. The laundry dryer according to claim 5, wherein below said hole a collecting basin is positioned for collecting liquid flowing through said hole.

7. The laundry dryer according to any claim 1, wherein said motor is received in a receptacle placed adjacent to said seat.

8. The laundry dryer according to claim 7, wherein between said seat and said receptacle a motor holding member is arranged.

9. The laundry dryer according to claim 7 wherein said receptacle is formed in a portion of said basement.

10. The laundry dryer according to any claim 1, comprising a basement placed under said drum, said seat being formed in a portion of said basement.

11. The laundry dryer according to claim 1, wherein said draining device comprises a tilted surface which fluidly connects a first region of said seat able to collect liquid to a second region at a lower elevation relative to said seat, in a mounted position of said laundry dryer.

12. The laundry dryer according to claim 1, wherein said draining device comprises a drain channel.

13. The laundry dryer according to claim 12, wherein said drain channel is fluidly connected to a collecting basin which, in a mounted position of said dryer, is located at a lower elevation compared to said bottom of said seat.

14. The laundry dryer according to claim 1, comprising a drying air moisture removing device comprising an air-air type heat exchanger or a section of a heat-pump system.

15. The laundry dryer according to claim 1, wherein said drum transmission system comprises a belt-pulley-arrangement.

16. The laundry dryer according to claim 1, wherein said drying air fan blows said air into said drum via a drying path, and said seat is positioned outside of said drying path.

* * * * *